US009398792B2

(12) United States Patent
Liao

(10) Patent No.: US 9,398,792 B2
(45) Date of Patent: Jul. 26, 2016

(54) REPLACEABLE DECORATION UNIT FOR AN ACCESSORY

(71) Applicant: Chen-Chieh Liao, Kaohsiung (TW)

(72) Inventor: Chen-Chieh Liao, Kaohsiung (TW)

( * ) Notice: Subject to any disclaimer, the term of this patent is extended or adjusted under 35 U.S.C. 154(b) by 54 days.

(21) Appl. No.: 14/243,131

(22) Filed: Apr. 2, 2014

(65) Prior Publication Data

US 2015/0101366 A1 Apr. 16, 2015

(30) Foreign Application Priority Data

Oct. 11, 2013 (TW) ..... 102218963 U

(51) Int. Cl.

| | |
|---|---|
| ***A44C 13/00*** | (2006.01) |
| ***A44C 25/00*** | (2006.01) |
| ***G04B 45/00*** | (2006.01) |
| *A44C 17/02* | (2006.01) |

(52) U.S. Cl.

CPC ..... *A44C 25/00* (2013.01); *G04B 45/0069* (2013.01); *A44C 17/0208* (2013.01); *A44C 25/004* (2013.01)

(58) Field of Classification Search

None

See application file for complete search history.

(56) References Cited

U.S. PATENT DOCUMENTS

| | | | | |
|---|---|---|---|---|
| 295,156 | A * | 3/1884 | Dueber | G04B 37/22 29/896.33 |
| 316,118 | A * | 4/1885 | Cooke | A44C 3/00 63/18 |
| 3,898,870 | A * | 8/1975 | Jacobson | A44C 25/002 40/790 |
| 4,224,364 | A * | 9/1980 | Hunt | A47G 33/08 40/617 |
| 5,617,751 | A * | 4/1997 | Song | A44B 15/00 206/37.1 |
| 6,324,869 | B1 * | 12/2001 | Vanlioglu | A44C 17/0291 63/26 |
| 8,448,464 | B2 * | 5/2013 | Varcin | A44C 9/02 63/15.1 |
| 2007/0234757 | A1 * | 10/2007 | Sherman | A44C 25/002 63/18 |

* cited by examiner

*Primary Examiner* — Jack W Lavinder
(74) *Attorney, Agent, or Firm* — patenttm.us

(57) ABSTRACT

A replaceable decoration unit for an accessory has an accommodating element, an outer cover and an outer decorating element. The decoration unit can be used in accessories such as earrings, watches, pendants, necklaces, waistlets, bracelets or key chains. When the outer cover is covered on the accommodating element, the outer decorating element is clamped and positioned between the outer cover and the accommodating element. The user can change the outer decorating element depending on usage demand. To change the outer decorating element, the user can open the outer cover and then remove the outer decorating element for replacement, thereby varying the look and style of the accessory. Besides, the outer decorating element can be made of solid materials such as metal or plastic, or soft materials such as fabric or leather, or the combination of the solid materials and the soft materials.

11 Claims, 8 Drawing Sheets

REPLACEABLE DECORATION UNIT FOR AN ACCESSORY

CROSS-REFERENCE TO RELATED APPLICATIONS

This application is based upon and claims priority under 35 U.S.C. 119 from Taiwan Patent Application No. M470551 filed on Oct. 11, 2013, which is hereby specifically incorporated herein by this reference thereto.

BACKGROUND OF THE INVENTION

1. Field of the Invention

The present invention relates to a replaceable decoration unit for an accessory, especially to a replaceable decoration device that is easy for assembling and disassembling to vary the look and style of the fashion accessory.

2. Description of the Prior Arts

Accessories, such as bracelets, earrings, necklaces, waistlets and watches, are invariable in model including aspects of shape, color and material. Taking watch for example, the watch has a main body and a watchband. The main body displays the time, and has a base seat, a winder, a time panel, watch hands, a transparent lens and decorations. The base seat has an accommodating space, and the winder, the time panel and watch hands are mounted in the accommodating space. The transparent lens is mounted on a top of the base seat. The decorations, such as crystal diamonds or any other gemstones, are mounted on the top of the base seat.

However, the decorations cannot be separated from the base seat, such that the user cannot vary the model of the accessory depending on mood or occasion. Thus, the decorations, which are the most crucial elements of the model, cannot be replaced, such that the decorations lack variation with limited enjoyment for wearing, which cannot satisfy the user and the market demand.

To overcome the shortcomings, the present invention provides a replaceable decoration unit for an accessory to mitigate or obviate the aforementioned problems.

SUMMARY OF THE INVENTION

The main objective of the present invention is to provide a replaceable decoration unit for an accessory that is easy for assembling and disassembling to vary the model of the fashion accessory.

The replaceable decoration unit for an accessory has an accommodating element, an outer cover and an outer decorating element. The accommodating element has an accommodating space, an opening and a first assembling segment. The opening communicates with the accommodating space. The first assembling segment is adjacent to the opening. The outer cover is disposed on the accommodating element, selectively closes the opening of the accommodating element, and has a cover body, a transparent window, a mounting segment and a second assembling segment. The transparent window is mounted on the cover body. The mounting segment is disposed on an outer wall of the cover body. The second assembling segment is disposed on the outer wall of the cover body, and corresponds to the first assembling segment. The outer decorating element is detachably mounted around the mounting segment of the cover body, and abuts the accommodating element.

The decoration unit as described can be used in accessories such as earrings, watches, pendants, necklaces, waistlets, bracelets or key chains. The outer decorating element is detachably mounted around the mounting segment of the cover body. When the outer cover is covered on the accommodating element, the outer decorating element is clamped and positioned between the outer cover and the accommodating element. The user can change the outer decorating element depending on usage demand. The outer cover is opened, and then the outer decorating element is removed to be replaced, thereby varying the model of the accessory and enhancing enjoyment of wearing. On the other hand, the outer decorating element can be made of solid materials such as metal or plastic, or soft materials such as fabric or leather, or the combination of the solid materials and the soft materials, allowing the users to build up personal styles.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
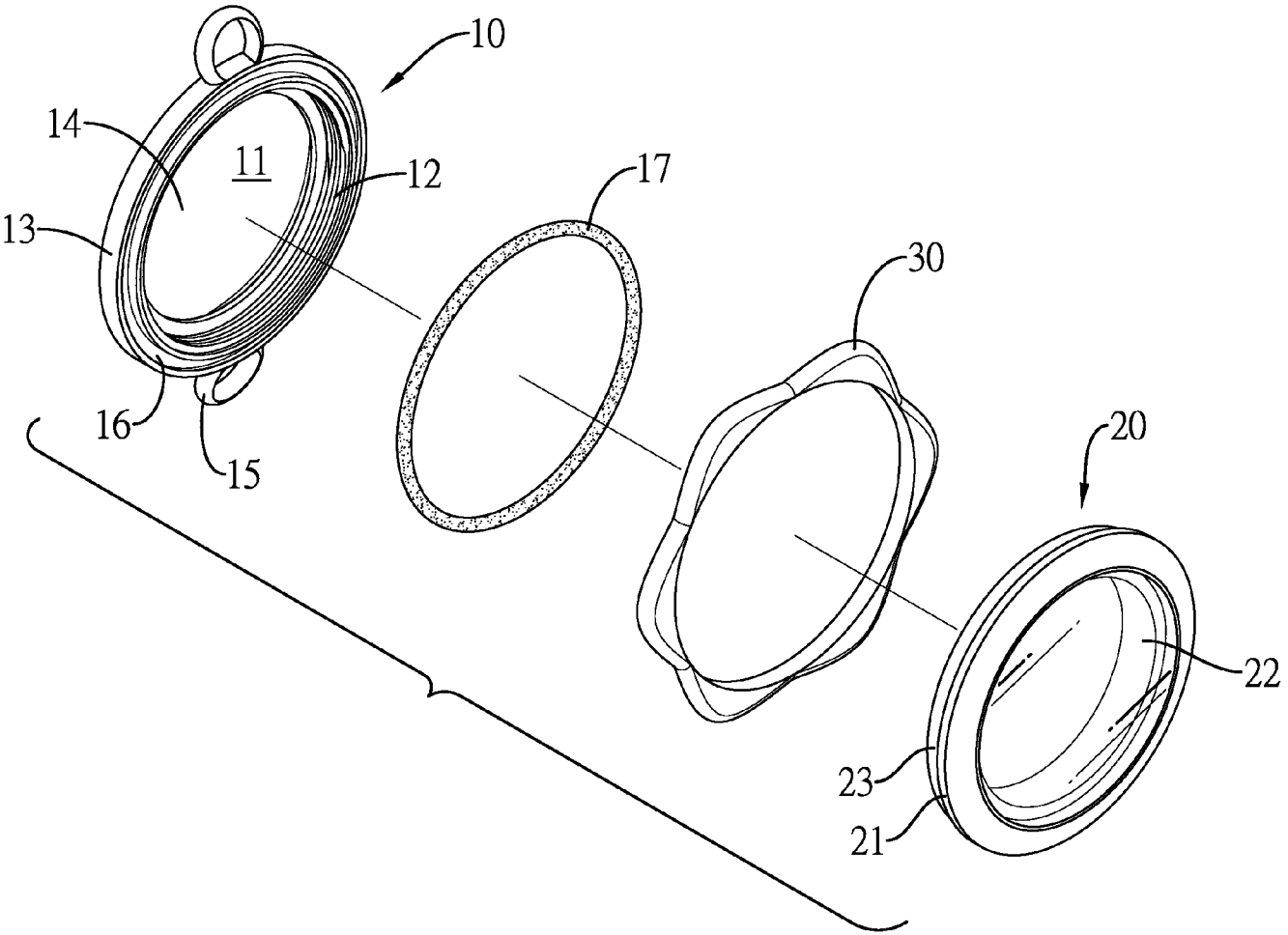
FIG. 1 is an exploded perspective view of a first embodiment of a replaceable decoration unit for an accessory in accordance with the present invention.
Figure 2:
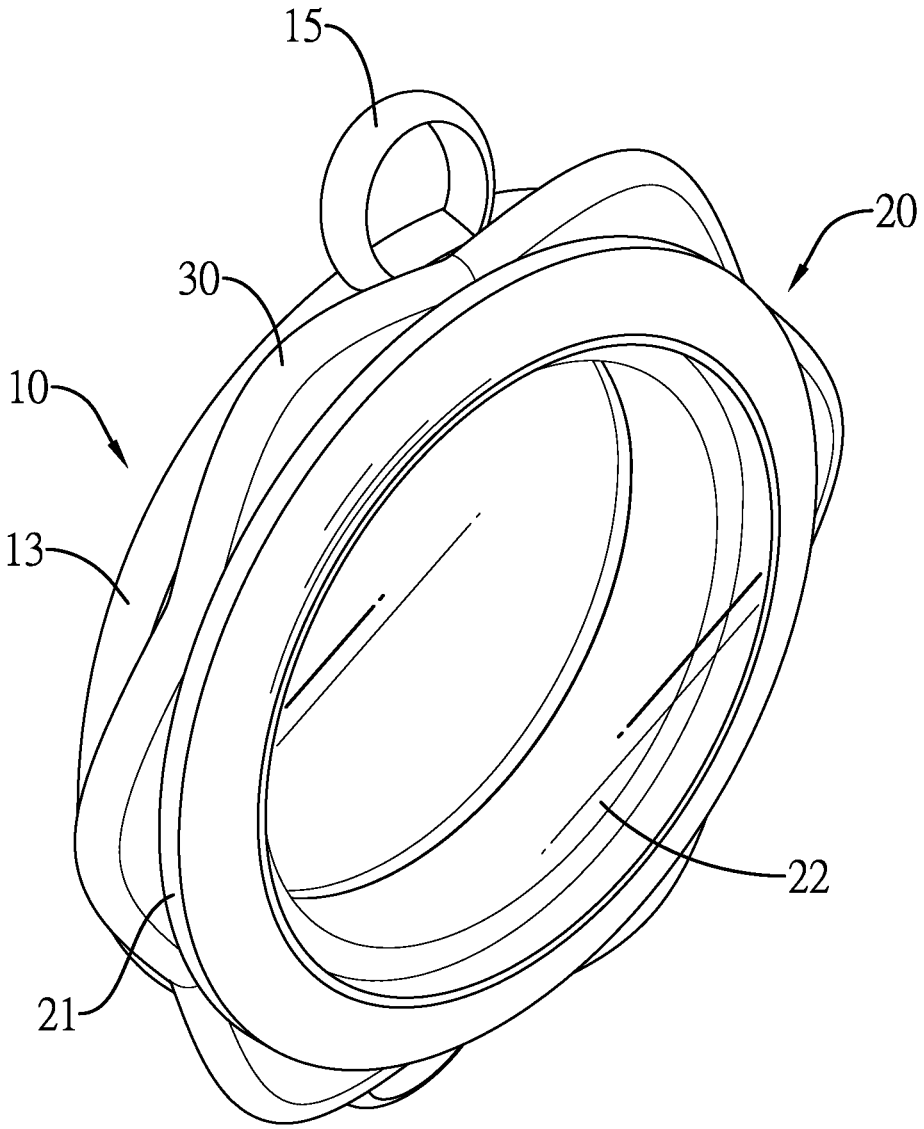
FIG. 2 is a perspective view of the replaceable decoration unit in FIG. 1.
Figure 4:
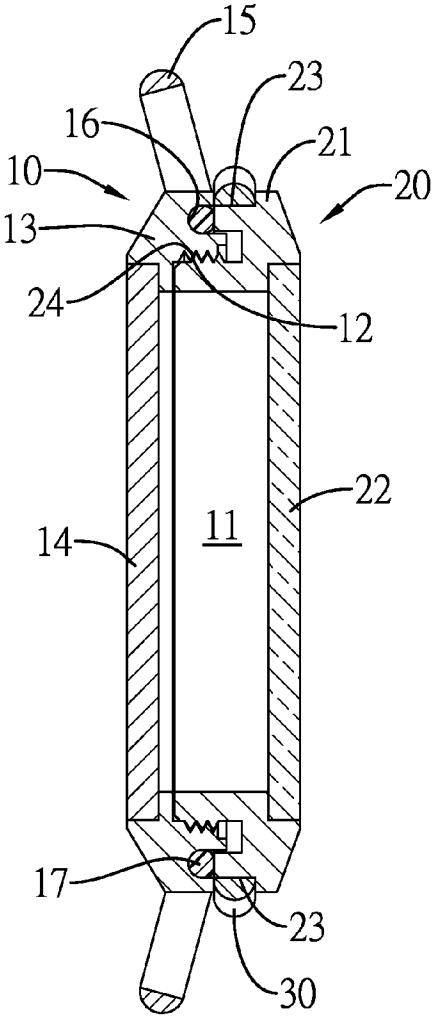
FIG. 4 is a side view in partial section of the replaceable decoration unit in FIG. 1.

With reference to FIGS. 1 to 4, a replaceable decoration unit for an accessory in accordance with the present invention comprises an accommodating element 10, an outer cover 20 and an outer decorating element 30.

The accommodating element 10 has an accommodating space 11, an opening and a first assembling segment 12. The opening communicates with the accommodating space 11. The first assembling segment 12 is adjacent to the opening. The accommodating element 10 has a seat body 13, a base panel 14 and at least one connecting segment 15. The base panel 14 is mounted on the seat body 13, and is made of transparent material or non-transparent material. The at least one connecting segment 15 is disposed on the seat body 13.

The outer cover 20 is disposed on the accommodating element 10 and selectively closes the opening of the accommodating element 10, and has a cover body 21, a transparent window 22, a mounting segment 23 and a second assembling segment 24. The transparent window 22 is mounted on the cover body 21, and faces the base panel 14. The mounting segment 23 and the second assembling segment 24 are disposed on an outer wall of the cover body 21. The second assembling segment 24 corresponds to the first assembling segment 12.

The outer decorating element 30 can be made of solid materials such as metal or plastic, or soft materials such as fabric or leather, or the combination of the solid materials and the soft materials. The outer decorating element 30 is detachably mounted around the mounting segment 23 of the cover body 21. The outer decorating element 30 abuts the seat body 13 when the cover body 21 covers the seat body 13.

The first assembling segment 12 and the second assembling 24 are threaded with each other. Alternatively, as shown in FIGS. 6 to 9, the outer cover 20 is pivotally connected to the accommodating element 10, and the first assembling segment 12 and the second assembling 24 are magnetic mechanisms to magnetically attract to each other. The first assembling segment 12 is embedded in the seat body 13, and the second assembling segment 24 is embedded in the cover body 21.

Figure 3:
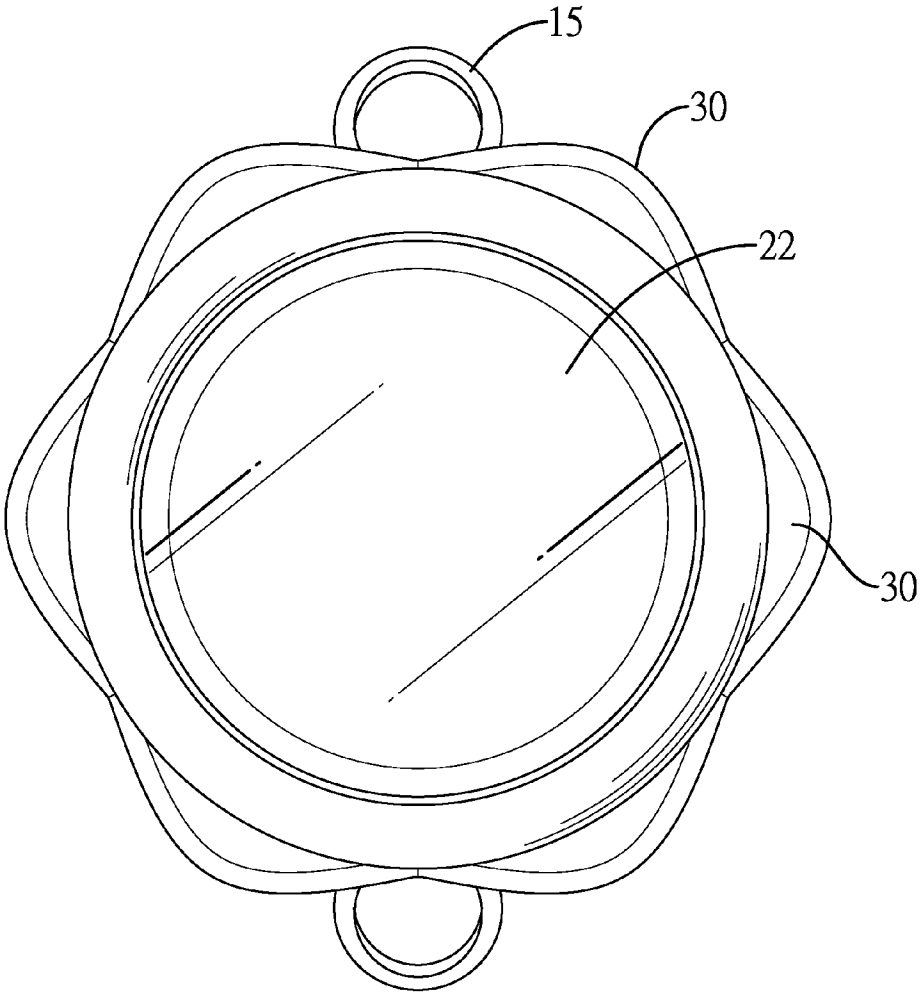
FIG. 3 is a front view of the replaceable decoration unit in FIG. 1.
Figure 5:
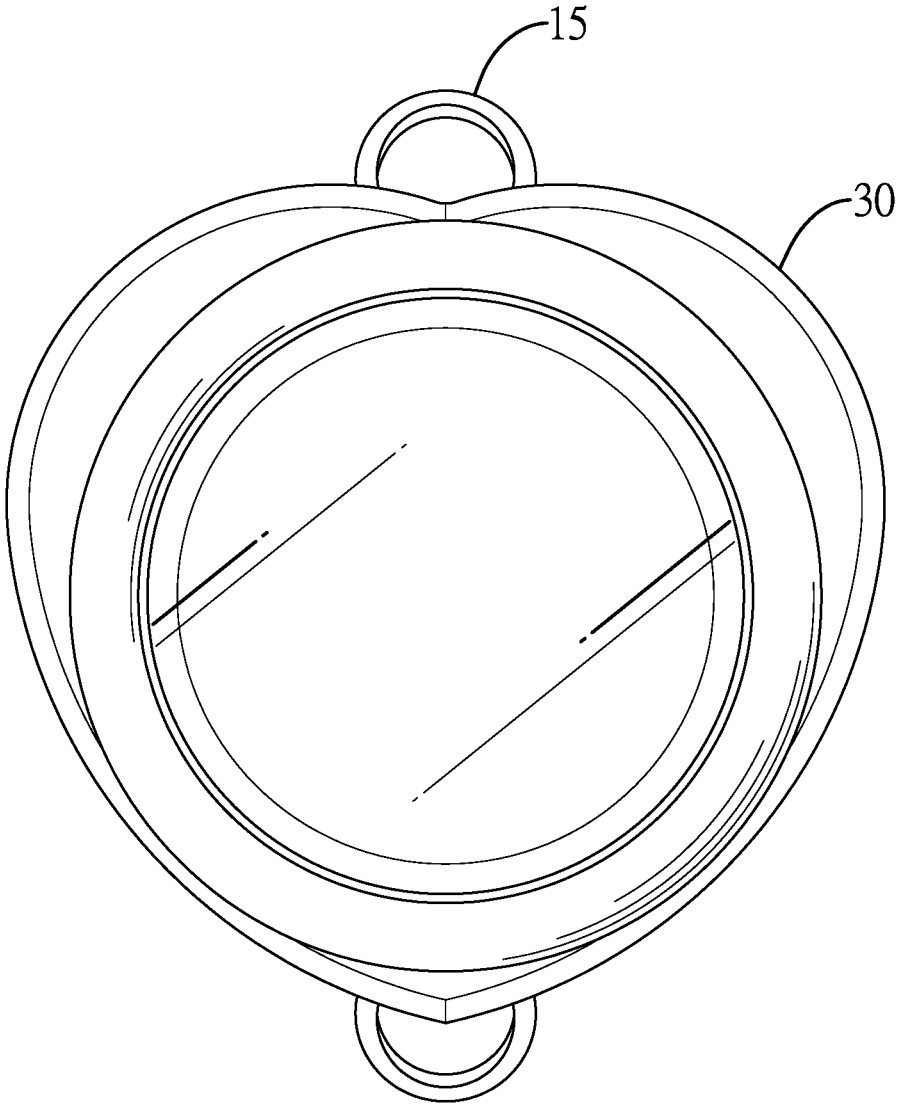
FIG. 5 is a front view of a second embodiment of a replaceable decoration unit for an accessory in accordance with the present invention.
Figure 6:
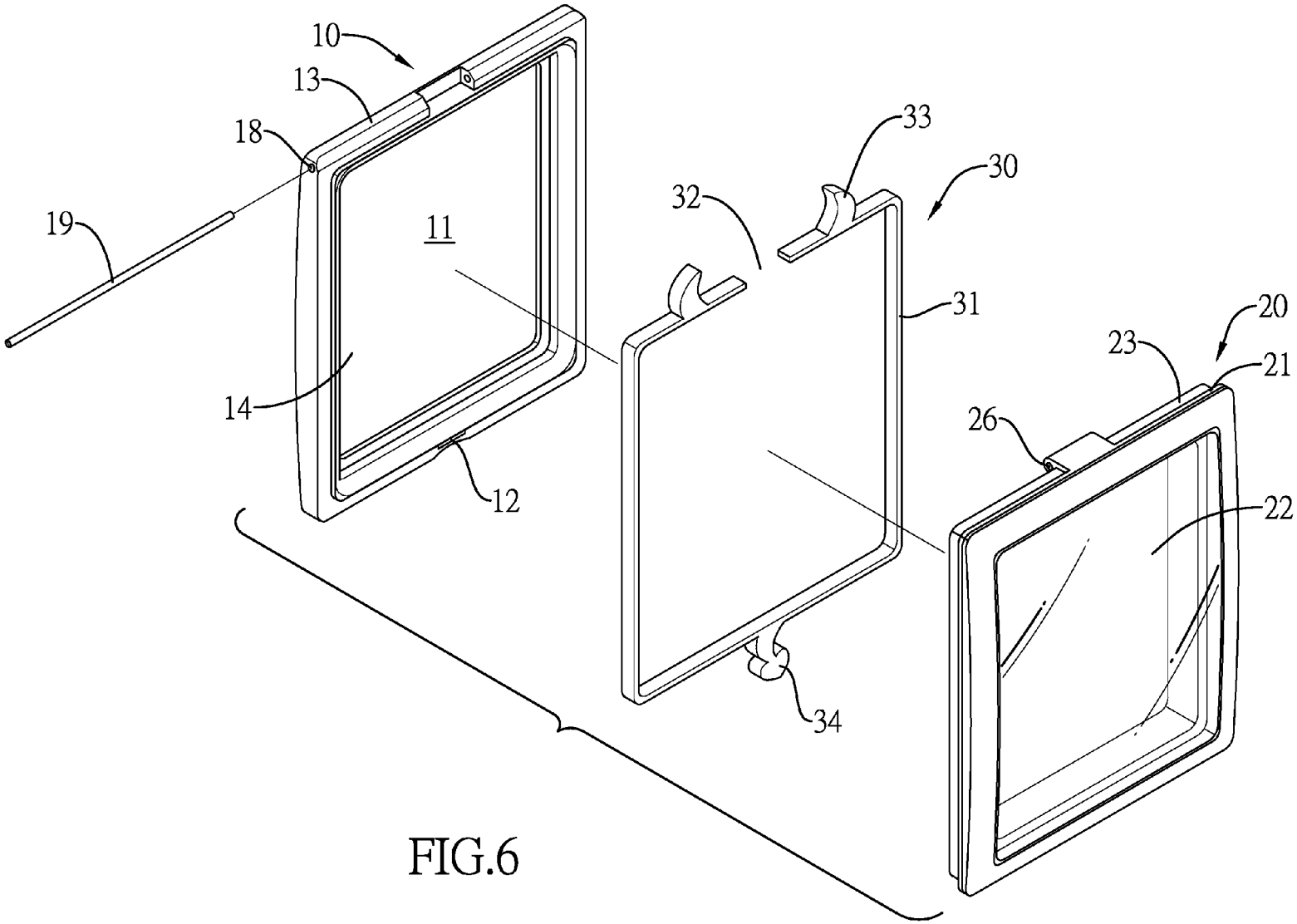
FIG. 6 is an exploded perspective view of a third embodiment of a replaceable decoration unit for an accessory in accordance with the present invention.
Figure 10:
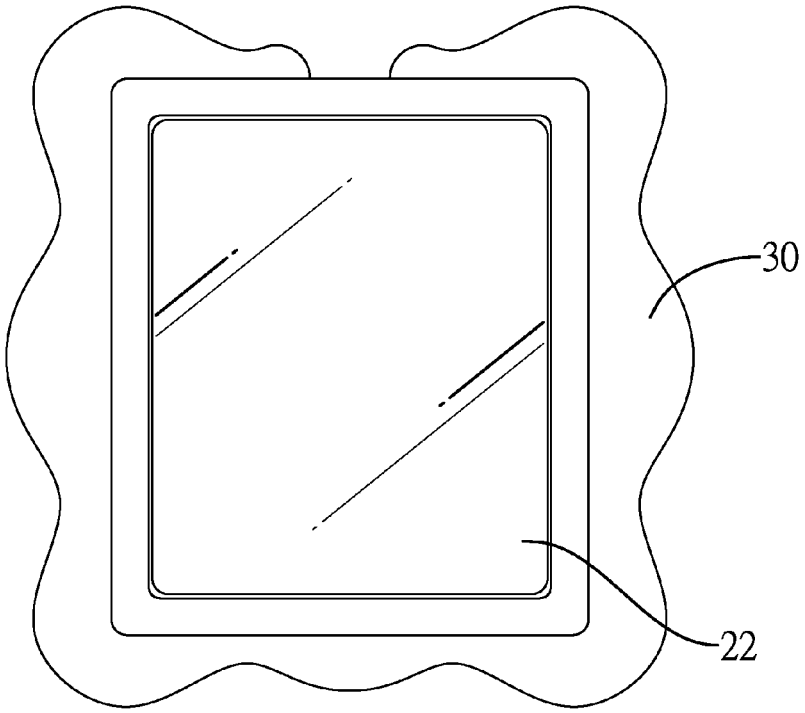
FIG. 10 is a front view of a fourth embodiment of a replaceable decoration unit for of an accessory in accordance with the present invention.
Figure 11:
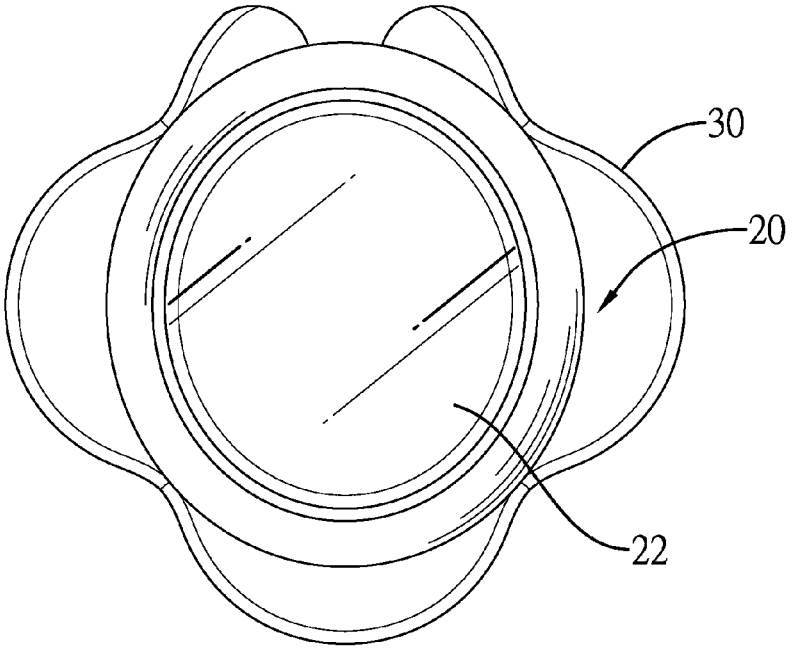
FIG. 11 is a front view of a fifth embodiment of a replaceable decoration unit for an accessory in accordance with the present invention.

With reference to FIG. 3, the outer decorating element 30 may be flower-shaped in outline. With reference to FIG. 5, the outer decorating element 30 may be heart-shaped in outline. With reference to FIG. 6, the outer decorating element 30 has a frame 31, two curved horns 33 and a pulling sheet 34. The frame 31 has a gap 32 formed therein at a position adjacent to the pivot junction between the accommodating element 10 and the outer cover 20. The curved horns 33 are disposed on the frame 31, are symmetrical relative to the gap 32, and are respectively disposed in two sides of the gap 32. The pulling sheet 34 is disposed on the frame 31 at a side opposite to the curved horns 33. The pulling sheet 34 resembles spade of poker in outline. With reference to FIGS. 10 and 11, the outer decorating element 30 has multiple curve sides with different curvatures in outline.

Figure 7:
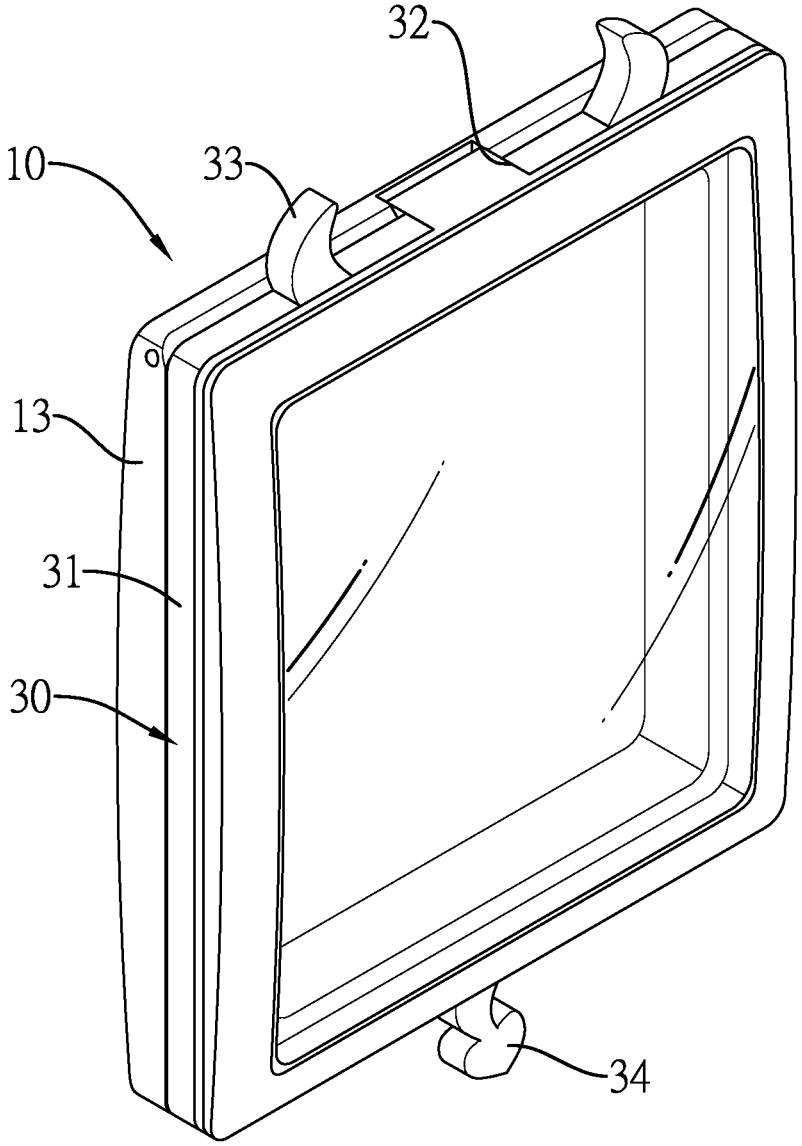
FIG. 7 is a perspective view of the replaceable decoration unit in FIG. 6.
Figure 9:
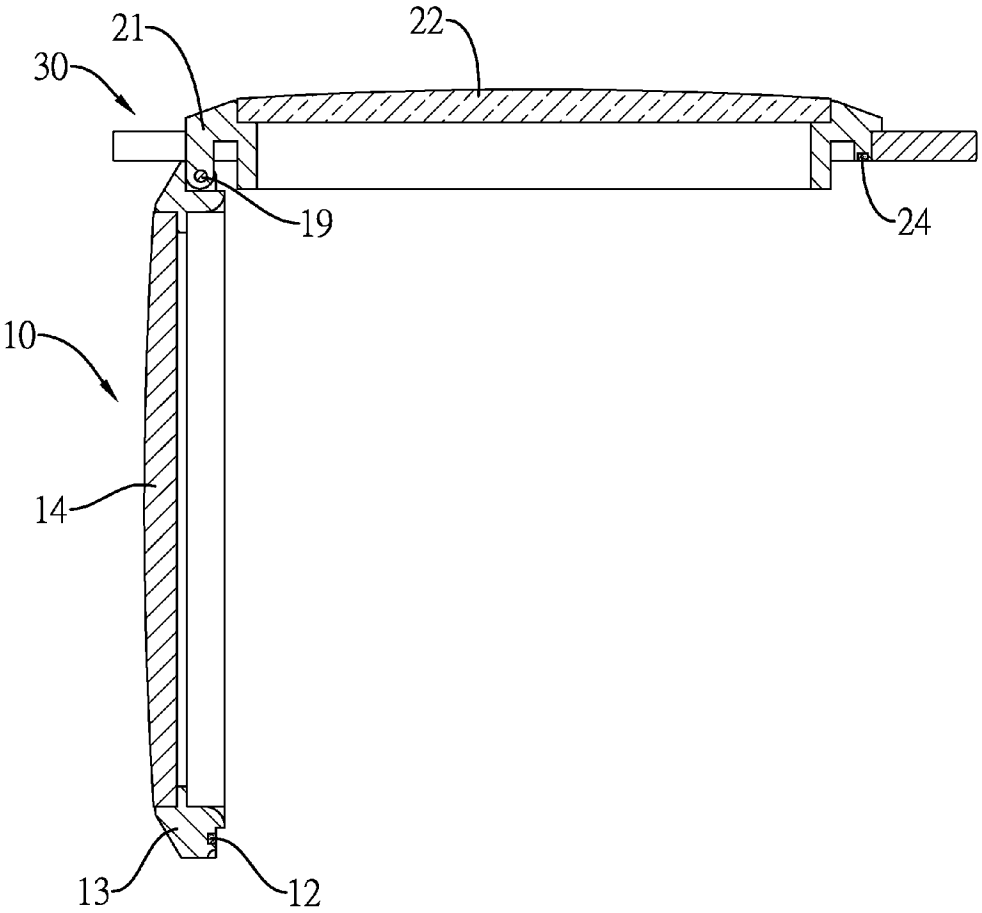
FIG. 9 is a side view in partial section of the replaceable decoration unit in FIG. 6, shown open.
Figure 8:
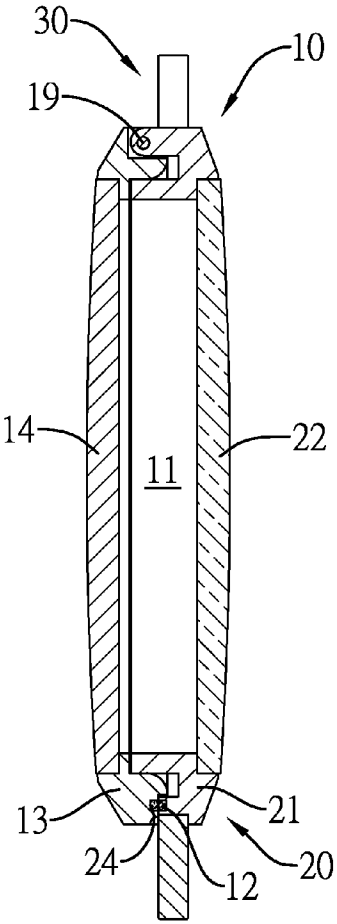
FIG. 8 is a side view in partial section of the replaceable decoration unit in FIG. 6, shown closed.

Besides, with reference to FIGS. 1 and 5, the outer cover 20 may be circular. With reference to FIGS. 7 and 10, the outer cover 20 may be rectangular. With reference to FIG. 11, the outer cover 20 may be oval.

In a first preferred embodiment of the replaceable decoration unit for an accessory as shown in FIGS. 1 to 4, the accommodating element 10 further has a recess 16 and a gasket 17. The recess 16 is formed in the accommodating element 10, and is disposed in an outer side of the accommodating element 10 relative to an edge around the opening. The gasket 17 is mounted in the recess 16. The outer decorating element 30 is mounted around the mounting segment 23 of the outer cover 20. The outer cover 20 is detachably screwed to the accommodating element 10. The outer decorating element 30 is positioned between the outer cover 20 and the accommodating element 10.

In a second preferred embodiment of the replaceable decoration unit for an accessory as shown in FIG. 5, the accommodating element 10 may be heart-shaped in outline.

With reference to FIGS. 6 to 9, the accommodating element 10 and the outer cover 20 are rectangular. The seat body 13 has a first pivot hole 18 formed in a side of the seat body 13. The cover body 21 has a second pivot hole 26 corresponding to the first pivot hole 18. A pintle 19 is mounted in the first pivot hole 18 and the second pivot hole 26 to pivotally mount the cover body 21 on the seat body 13. The first assembling segment 12 is disposed on the seat body 13 at a side opposite to the first pivot hole 18, and the second assembling segment 24 is disposed in the cover body 21 at a side opposite to the second pivot hole 26. The first assembling segment 12 and the second assembling segment 24 magnetically attract to each other to be positioned.

The replaceable decoration unit for an accessory can be used in fashion accessories such as earrings, watches, pendants, necklaces, waistlets, bracelets or key chains. The accommodating space 11 of the accommodating element 10 may accommodate other kinds of decorations, or may be installed with a winder of the watch such that the decoration unit becomes a watch to tell time. Besides, the at least one connecting segment 15 on the seat body 13 may be connected to a belt or a chain such that the decoration unit becomes a bracelet, a waistlet or a necklace. In addition, the at least one connecting segment 15 may be connected to an ear hook such that the decoration unit becomes an earring.

The outer decorating element 30 is detachably mounted around the mounting segment 23 of the cover body 21. When the outer cover 20 is covered on the accommodating element 10, the outer decorating element 30 is clamped and positioned between the outer cover 20 and the accommodating element 10. For changing the outer decorating element 30, the outer cover 20 is opened, and then the outer decorating element 30 is separated from the mounting segment 23 to be replaced.

The outer decorating element 30 of the replaceable decoration unit for an accessory can be assembled and disassembled to and from the outer cover 20, which enables the outer decorating element 30 to be changed conveniently, thereby varying the model of the accessory and enhancing enjoyment of wearing. Moreover, the accommodating space 11 can accommodate other decorations, also enhancing variations of the model of the accessory and enjoyment of wearing. Furthermore, the connecting segment 15 enhances the applicability of the replaceable decoration unit for an accessory. Even though numerous characteristics and advantages of the present invention have been set forth in the foregoing description, together with details of the structure and features of the invention, the disclosure is illustrative only. Changes may be made in the details, especially in matters of model, size, and arrangement of parts within the principles of the invention to the full extent indicated by the broad general meaning of the terms in which the appended claims are expressed.

What is claimed is:

1. A replaceable decoration unit for an accessory, the replaceable decoration unit comprising:

an accommodating element having an accommodating space;

an opening communicating with the accommodating space; and a first assembling segment being adjacent to the opening;

an outer cover disposed on the accommodating element, selectively closing the opening of the accommodating element, and having a cover body;

a transparent window mounted on the cover body;

a mounting segment disposed on an outer wall of the cover body; and a second assembling segment disposed on the outer wall of the cover body, and corresponding to the first assembling segment; and an outer decorating element detachably mounted around the mounting segment of the cover body, and abutting the accommodating element.

2. The replaceable decoration unit for an accessory as claimed in claim 1, wherein the accommodating element has a seat body; and a base panel mounted on the seat body, and facing the transparent window.

3. The replaceable decoration unit for an accessory as claimed in claim 2, wherein the first assembling segment and the second assembling are threaded with each other.

4. The replaceable decoration unit for an accessory as claimed in claim 3 further comprising at least one connecting segment disposed on the seat body.

5. The replaceable decoration unit for an accessory as claimed in claim 2, wherein the first assembling segment and the second assembling are magnetic mechanisms to magnetically attract to each other.

6. The replaceable decoration unit for an accessory as claimed in claim 5 further comprising at least one connecting segment disposed on the seat body.

7. The replaceable decoration unit for an accessory as claimed in claim 2 further comprising at least one connecting segment disposed on the seat body.

8. The replaceable decoration unit for an accessory as claimed in claim 1, wherein the first assembling segment and the second assembling are threaded with each other.

9. The replaceable decoration unit for an accessory as claimed in claim 8 further comprising at least one connecting segment disposed on the seat body.

10. The replaceable decoration unit for an accessory as claimed in claim 1, wherein the first assembling segment and the second assembling are magnetic mechanisms to magnetically attract to each other.

11. The replaceable decoration unit for an accessory as claimed in claim 10 further comprising at least one connecting segment disposed on the seat body.

* * * * *